US006814259B1

(12) United States Patent
Foster et al.

(10) Patent No.: US 6,814,259 B1
(45) Date of Patent: Nov. 9, 2004

(54) CHILD RESISTANT CLOSURE WITH SAFETY LOCK RING

(75) Inventors: Donald D. Foster, St. Charles, MO (US); Philip L. Nelson, Wildwood, MO (US)

(73) Assignee: Continental AFA Dispensing Company, St. Peters, MO (US)

( * ) Notice: Subject to any disclaimer, the term of this patent is extended or adjusted under 35 U.S.C. 154(b) by 37 days.

(21) Appl. No.: 10/413,674

(22) Filed: Apr. 15, 2003

(51) Int. Cl.[7] ..... B67D 5/40
(52) U.S. Cl. ..... 222/153.09; 222/383.1
(58) Field of Search ..... 222/153.09, 153.1, 222/383.1

(56) References Cited

U.S. PATENT DOCUMENTS 4,366,921 A * 1/1983 Kirk, Jr. ..... 222/153.09
5,147,074 A * 9/1992 Battegazzore ..... 222/383.1
5,169,033 A * 12/1992 Shay ..... 222/153.09
5,257,724 A * 11/1993 Steijns ..... 222/153.06
5,873,496 A * 2/1999 Montaner et al. ..... 222/153.09
6,112,921 A 9/2000 Robinson
6,138,873 A * 10/2000 Gramola ..... 222/153.14
6,155,462 A * 12/2000 Brecheisen et al. .... 222/153.09
6,327,770 B1 12/2001 Konefal et al.
6,508,373 B1 1/2003 Robinson

* cited by examiner

*Primary Examiner*—Joseph A. Kaufman
(74) *Attorney, Agent, or Firm*—Thompson Coburn, LLP

(57) ABSTRACT

A child resistant closure apparatus between a container and a cap comprises a separate safety lock ring. The lock ring is mounted over the container neck and the cap is mounted on the container neck and engages with a pair of lock clasps on opposite sides of the lock ring. Finger pads on opposite sides of the lock ring are squeezed and compressed by one hand of the user while the cap is rotated on the container neck by the other hand of the user to separate the cap from the container. The lock ring is designed to be employed with container and cap closure assemblies of at least two different sizes, reducing their manufacturing costs. Additionally, the lock ring may be removed from the container if it is desired that the container and cap not have a child resistant closure apparatus.

25 Claims, 6 Drawing Sheets

CHILD RESISTANT CLOSURE WITH SAFETY LOCK RING

BACKGROUND OF THE INVENTION (1) Field of the Invention

The present invention pertains to a child resistant closure between a container and a cap that also comprises a separate safety lock ring. The lock ring is mounted over the neck of the container and the cap is mounted on the neck of the container and engages with a pair of lock clasps on opposite sides of the safety lock ring. Finger pads on opposite sides of the safety lock ring must be squeezed and compressed by one hand of the user while the cap is rotated on the container neck by the other hand of the user in order to separate the cap from the container. The safety lock ring is designed to be employed with container and cap closure assemblies of at least two different sizes, which eliminates a need for separate safety lock rings for the two different sizes of containers and caps and reduces their manufacturing costs.

(2) Description of the Related Art

Child resistant closures are often employed on containers having potentially harmful contents such as pharmaceutical drugs, household cleaning liquids and household insecticides, to name only a few applications. One example of the construction of a child resistant closure between a container and cap includes a locking mechanism on the container that must be moved by one hand of the user while the cap is removed from the container by the other hand of the user. The requirement of using two hands to perform two movements on the container and cap not only perplexes children attempting to remove the cap from the container, but also many adults.

The typical child resistant closure is incorporated into the construction of the container and the cap. In plastic containers and caps, component parts of the child resistant closure mechanisms are molded onto both the containers and the caps. Incorporating a child resistant closure mechanism in the construction of the container and the cap increases the costs of manufacturing the container and cap over the costs of manufacturing a container and cap that do not incorporate a child resistant closure.

In addition, because the container and cap are manufactured with the child resistant closure mechanism as part of their constructions, the child resistant closure mechanism cannot be removed from the container and cap when the child resistant closure is not required or desired. Individuals who do not have children that purchase products contained in container and cap assemblies incorporating child resistant closures often find the presence of the child resistant closure to be an inconvenience.

What would overcome these disadvantages associated with child resistant closures employed on container and cap assemblies is a child resistant closure apparatus that could be removed from the container and cap assembly when desirable. In addition, a child resistant closure apparatus that could be employed with container and cap assemblies of more than one size would reduce the costs associated with manufacturing the two different sizes of container and cap assemblies comprising child resistant closure mechanisms.

SUMMARY OF THE INVENTION

The child resistant closure apparatus of the present invention overcomes the disadvantages associated with prior art child resistant closures by providing a closure mechanism that can be removed from the container and cap assembly when desired. The child resistant closure apparatus also provides a safety lock ring that can be employed with at least two different size container and cap assemblies, thereby providing a reduction in manufacturing costs by providing a single part that can be employed with two different container and cap assemblies. These advantages are provided by the child resistant closure apparatus of the invention which is basically comprised of a container, a cap removably attachable to the container and a safety lock ring that is removably attachable to the container. In the preferred embodiment of the invention each of these three component parts are manufactured of a plastic material, as is conventional in the art.

The container has a hollow interior volume and an opening in the container provides access to the interior volume. A cylindrical neck surrounds the opening. The container neck exterior surface has an attachment mechanism formed thereon that is complementary to an attachment mechanism of the cap. The container neck is formed with a pair of arcuate ridges that project outwardly from the container neck on opposite sides of the container neck. The container neck is also formed with a pair of ribs that project outwardly from the container neck just below the ridges.

The lock ring has a cylindrical sidewall that is dimensioned to pass easily over the container neck with the sidewall spaced radially outwardly from the container neck. A pair of finger pad portions of the sidewall project radially outwardly from opposite sides of the sidewall. A pair of clasps project radially inwardly from the finger pads to distal ends of the clasps. The distal end of each clasp is formed with a hook that projects upwardly from the clasp. The lock ring is also formed with a pair of flanges that project radially inwardly from opposite sides of the sidewall at positions that are oriented 90° relative to the lock ring clasps.

The lock ring is removably attached to the container neck by passing the lock ring over the neck and positioning the lock ring flanges on the tops of the container neck ridges. Pushing the lock ring downwardly causes the lock ring to resiliently deflect moving the lock ring flanges radially outwardly and passing the flanges over the container neck ridges. The lock ring flanges engage beneath the container neck ridges thereby removably attaching the lock ring to the container neck.

In the preferred embodiment of the invention the cap is a cap of a trigger sprayer that removably attaches the trigger sprayer to the container. However, the cap of the child resistant closure need not removably attach a separate component to the container and can be employed only to provide a removable closure over the opening of the container neck. The cap has a cylindrical skirt that is dimensioned to fit over the container neck and inside of the lock ring. The interior of the cap skirt is formed with an attachment mechanism complementary to the attachment mechanism of the container neck. In addition, the cap skirt interior is provided with a pair of lugs on opposite sides of a cap. Each lug is formed with a cam surface and a stop surface.

In attaching the cap to the container neck the cap is moved downwardly over the neck and is rotated relative to the neck in the manner conventional with screw threaded attachment mechanisms or bayonet type attachment mechanisms. As is conventional, the cap is rotated in a clockwise direction over the container neck which causes the cam surfaces of the cap lugs to come into engagement with the hook portions of the lock ring clasps. The rotational movement of the cap causes the clasp hook portions of the lock ring to slide over the cam surfaces. The resiliency of the lock ring enables the clasp hook portions to move radially inwardly as they slide over the lug cam surfaces. When the clasp hooks of the lock ring have passed over the cap lug cam surfaces the resiliency of the lock ring causes the clasp hooks to snap into place adjacent the cap lug stop surfaces. The positioning of the clasp hooks of the lock ring adjacent the cap lug stop surfaces prevents the cap from being rotated in the counterclockwise direction to remove the cap from the container neck.

To remove the cap from the container neck it is necessary to first manually squeeze the finger pads on the opposite sides of the lock ring compressing the resiliency of the lock ring. This causes the clasp hooks of the lock ring to move radially inwardly toward each other displacing them from their previous positions adjacent the cap lug stop surfaces. With the clasp hooks displaced from the cap lug lock surfaces, the cap can now be rotated with the other hand of the user in a counterclockwise direction to remove the cap from the container neck.

The lock ring of the child resistant closure apparatus of the invention is dimensioned to be employed with two different size container and cap assemblies. In the preferred embodiment the lock ring may be employed with a container and cap assembly having a 24 mm diameter container neck and a 28 mm diameter container neck. However, container and cap assemblies having other neck dimensions may be employed by changing the dimensions of the lock ring. By enabling use of a single size lock ring with two different size container and cap assemblies to provide those assemblies with a child resistant closure apparatus, the manufacturing costs of the two different sizes of container and cap assemblies is reduced.

In addition, because the lock ring is removably attached to the container by the resiliency of the lock ring and the engagement of the lock ring flanges beneath the container neck ridges, the lock ring can be removed from the container if desired. This enables the child resistant closure apparatus to be removed from the container and cap assembly where it is desired that the container and cap assembly not have a child resistant closure apparatus.

BRIEF DESCRIPTIONS OF THE DRAWING FIGURES

Further features of the invention are set forth in the following detailed description of the preferred embodiment of the invention and in the drawing figures wherein.

DETAILED DESCRIPTION OF THE PREFERRED EMBODIMENT

Figure 1:
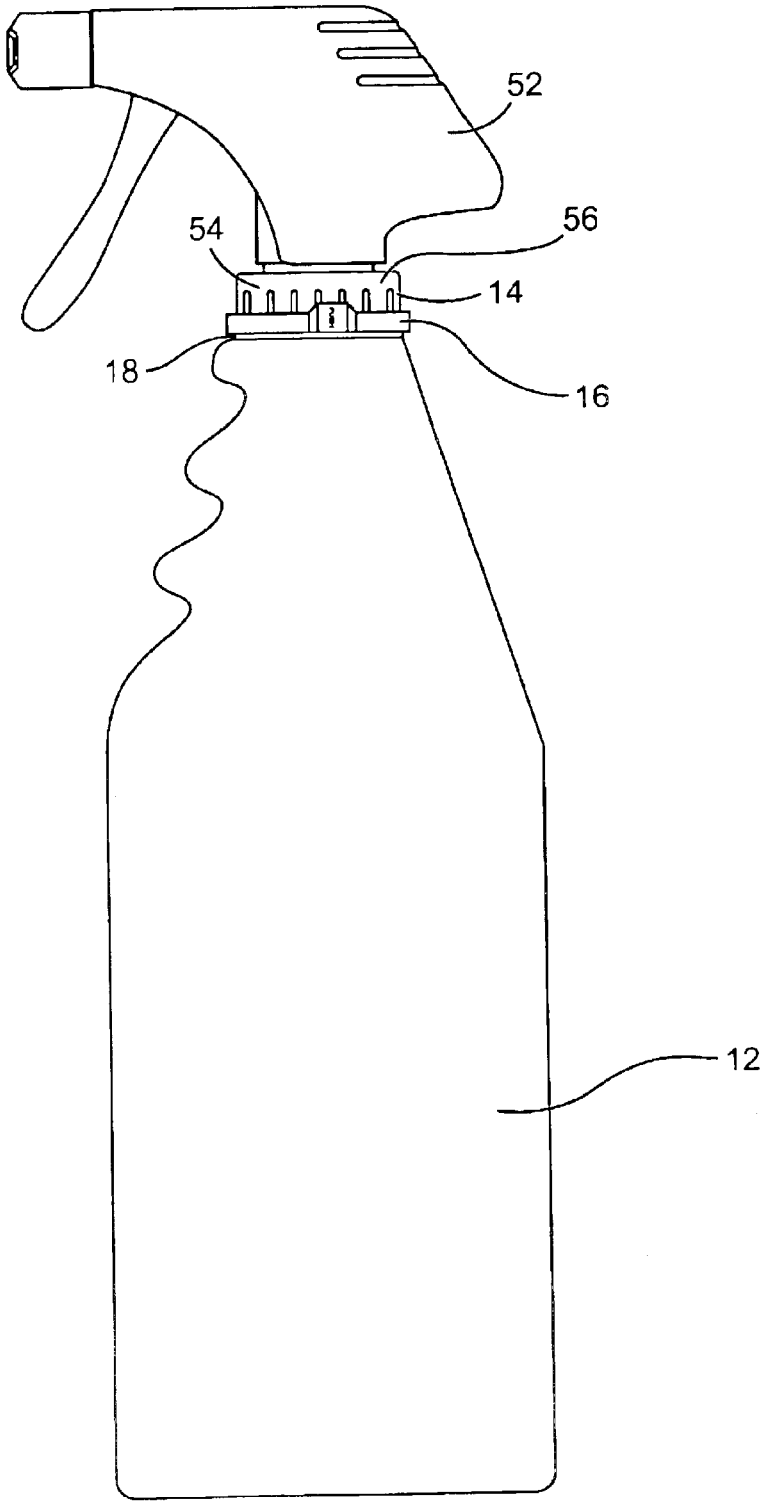
FIG. 1 is an elevation view of the child resistant closure apparatus of the invention attaching a trigger sprayer to a bottle container.

In describing the child resistant closure apparatus of the invention, terms such as "top," "bottom," "above" and "below" will be used. It should be understood that these terms are being used to describe the component parts of the invention in the typical upright orientation of the container 12 shown in FIG. 1. Because the orientation of the container 12 will change in use of the apparatus of the invention, the terms should not be interpreted as limiting.

The child resistant closure apparatus of the present invention is basically comprised of a bottle container 12, a cap 14 that is removably attachable to the bottle container 12 and a safety lock ring 16 that is also removably attachable to the bottle container 12. In the preferred embodiment of the invention, each of these three component parts are manufactured of a resilient plastic material.

The bottle container 12 has a hollow interior volume and an opening in the container that provides access to the interior volume. A cylindrical neck 18 surrounds the opening. The cylindrical container neck 18 has a center axis 22 that defines mutually perpendicular axial and radial directions relative to the container 12. The container neck has an exterior surface with spiraling screw threading 24 formed thereon that is complementary to screw threading of the cap 14. The complementary screw threading of the container neck and cap enable the cap to be removably attached to the container neck. However, other types of attachment mechanisms may be used in lieu of the screw threading, for example a bayonet type attachment mechanism or other equivalent types of attachment mechanisms. The bottle container 12 and the neck 18 are, for the most part, conventional. However, the container neck 18 is formed with novel structural features.

Figure 3:
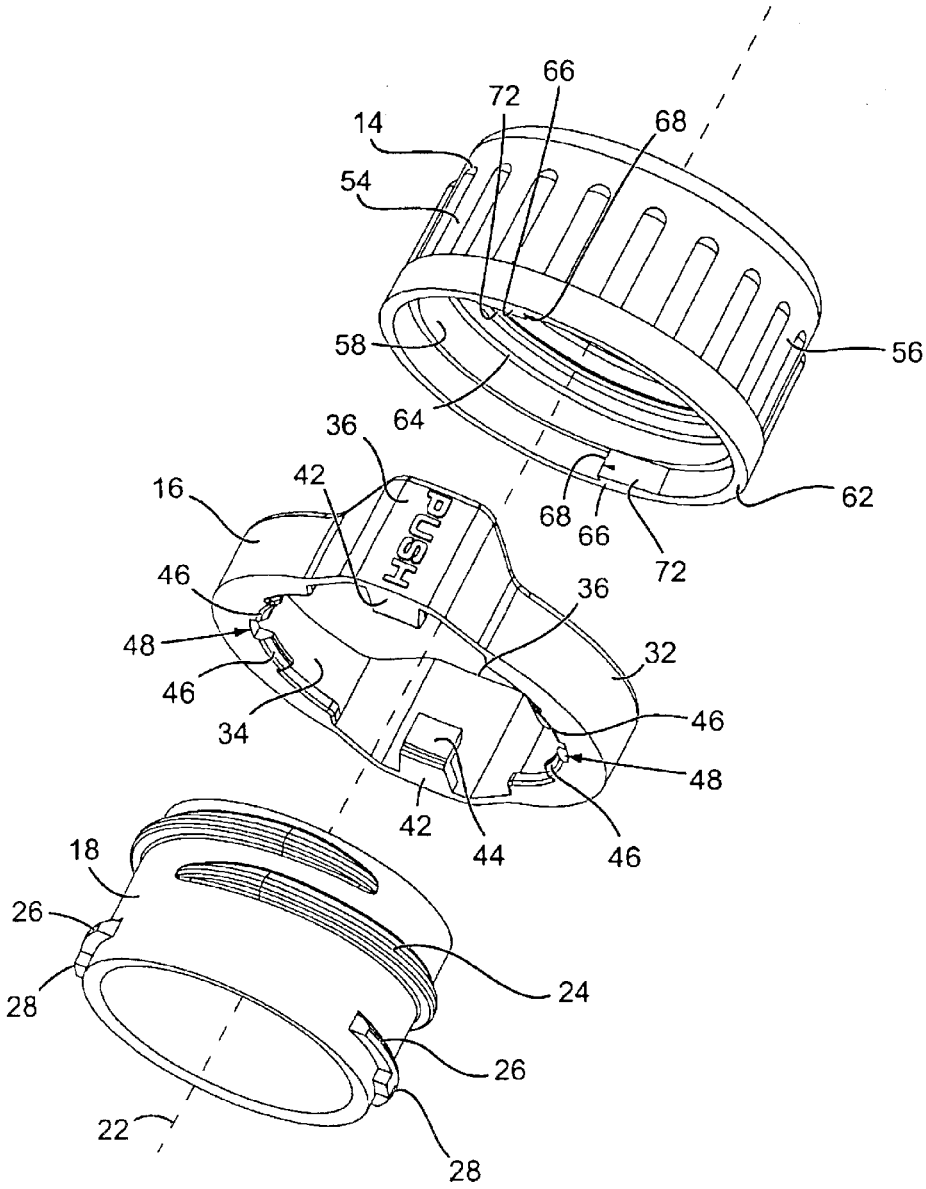
FIG. 3 is a perspective view of the container neck, the lock ring and the cap disassembled from each other.
Figure 4:
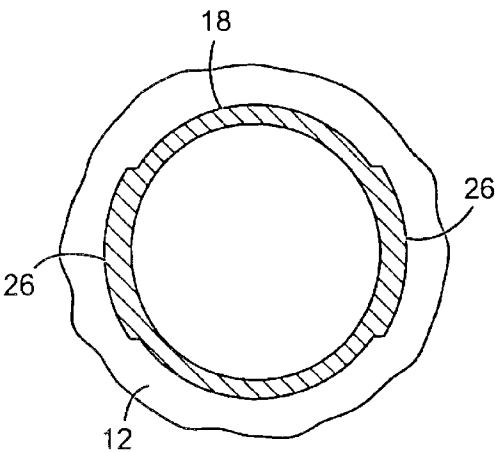
FIG. 4 is a plan view of the top of the container with the cap and lock ring removed.
Figure 7:
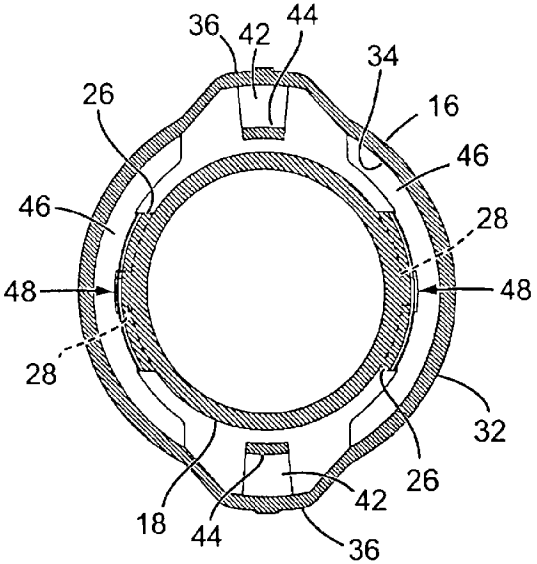
FIG. 7 is a plan view of the lock ring mounted on the container.

A pair of arcuate ridges 26 are formed on diametrically opposite sides of the container neck. The arcuate ridges 26 project radially outwardly a short distance from the container neck exterior surface and extend circumferentially a short distance around the container neck. As best seen in FIG. 4, the arcuate ridges 26 each extend around less than one quarter of the container neck circumference. A pair of axially oriented ribs 28 also project radially outwardly from the container neck exterior surface. The ribs 28 extend outwardly from the container neck exterior surface to the same extent as the arcuate ridges 26. Each of the ribs 28 is positioned at the center of one of the arcuate ridges 26 just below the arcuate ridge as shown in FIG. 3.

The lock ring 16 has a cylindrical side wall 32 with an interior diameter dimensioned to enable the lock ring to pass easily over the container neck 18. The interior diameter dimension of the side wall 32 positions the side wall interior surface 34 radially outwardly from the exterior surface of the container neck 18. The lock ring side wall 32 has an axial length dimension that is less than half of the length dimension of the container neck 18.

Figure 5:
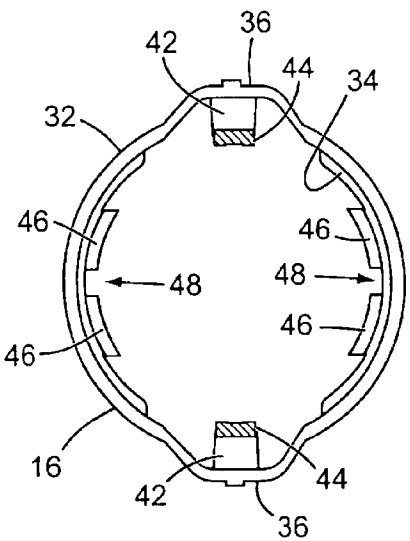
FIG. 5 is a plan view of the lock ring removed from the container.
Figure 9:
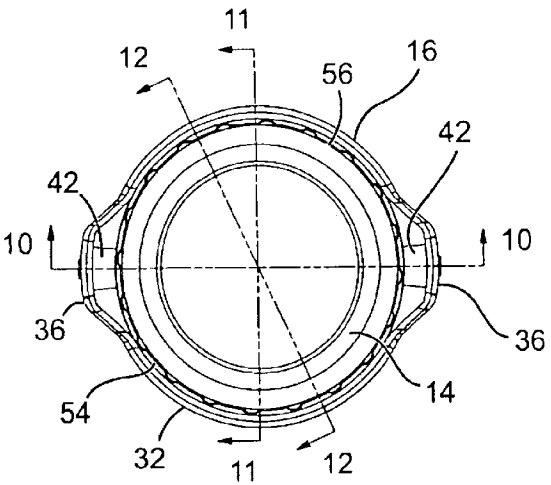
FIG. 9 is a top plan view of the lock ring mounted on the container neck and the cap mounted on the container neck.

In viewing the plan view of the lock ring side wall 32 shown in FIG. 5, it can be seen that the side wall has a generally circular configuration except for the presence of a pair of finger pad sections 36 that project radially outwardly from the opposite sides of the side wall. A pair of clasps 42 project radially inwardly from the bottoms of the two finger pads 36 to distal ends of the clasps. The distal end of each clasp is formed with a hook 44 that projects axially upwardly from the clasp.

A pair of arcuate flanges 46 are formed on the interior surface 34 of the lock ring side wall 32. The flanges 46 are positioned adjacent the bottom edge of the side wall 32, and each, flange 46 is centered on the side wall interior surface 34 relative to the pair of clasps 42. Each of the flanges 46 has an arcuate length that is less than one quarter of the circumference of the lock ring side wall 32. A notch 48 is formed in the center of each flange.

The lock ring 16 is removably attached to the container neck 18 by passing the lock ring over the neck and positioning the lock ring flanges 46 on the tops of the container neck ridges 26. Pushing the lock ring 16 downwardly causes the lock ring to resiliently flex, moving the lock ring flanges 46 radially outwardly which causes the flanges to pass over the container neck ring ridges 26. After passing over the neck ring ridges 26, the lock ring flanges 46 engage beneath the ridges 26 and thereby removably attach the lock ring 16 to the container neck 18 and prevent axial movement of the lock ring 16 relative to the container 12. The ribs 28 on the container neck 18 engage in the notches 48 at the centers of the lock ring flanges 46 and thereby prevent rotational movement of the lock ring 16 relative to the container 12.

Figure 2:
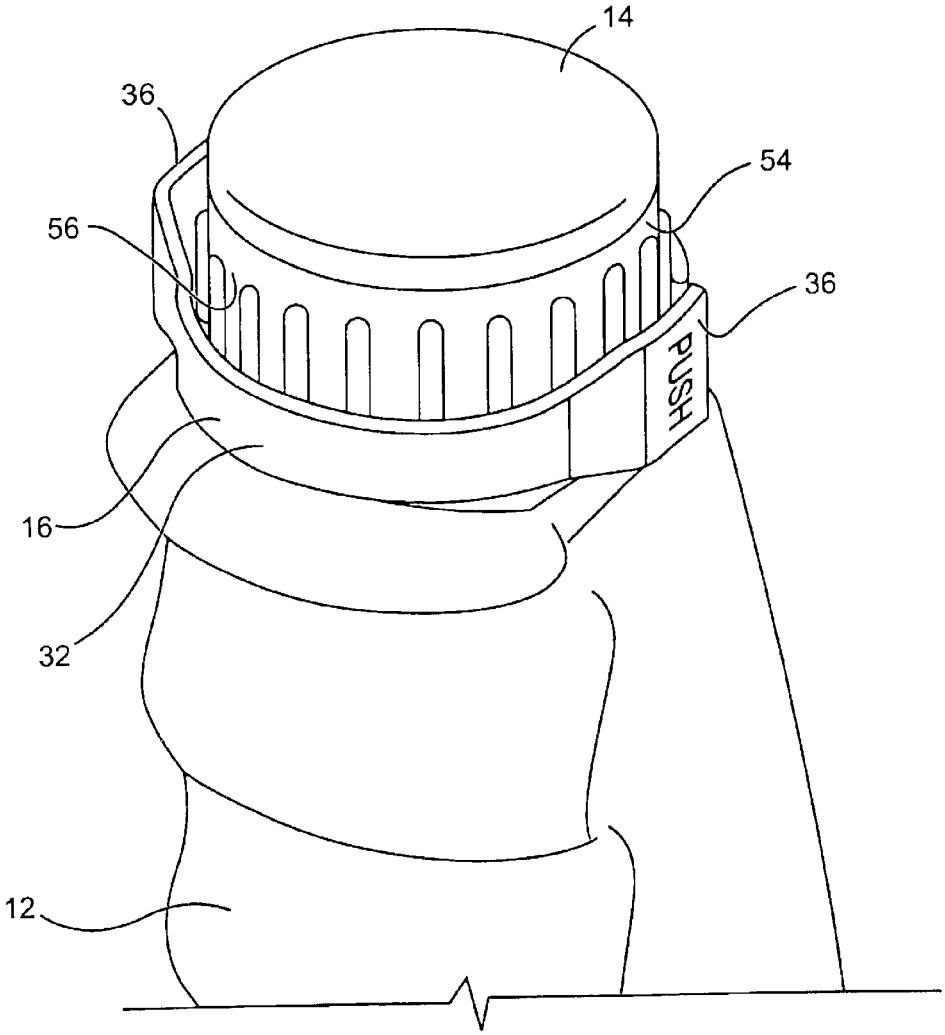
FIG. 2 is a partial perspective view of the child resistant closure apparatus of the invention comprising a bottle container, a cap mounted on the container and a lock ring mounted on the container.

In the preferred embodiment of the invention the cap 14 removably attaches a trigger sprayer 52 to the container as shown in FIG. 1. The trigger sprayer 52 is a hand-operated trigger sprayer of the type known in the art. Because the construction of the trigger sprayer 52 is known, it will not be described in detail. Although the cap 14 preferably removably attaches the trigger sprayer 52 to the container 12, the cap of the child resistant closure apparatus can be employed without the trigger sprayer 52 to provide a removable closure over the opening of the container neck as shown in FIG. 2.

Figure 8:
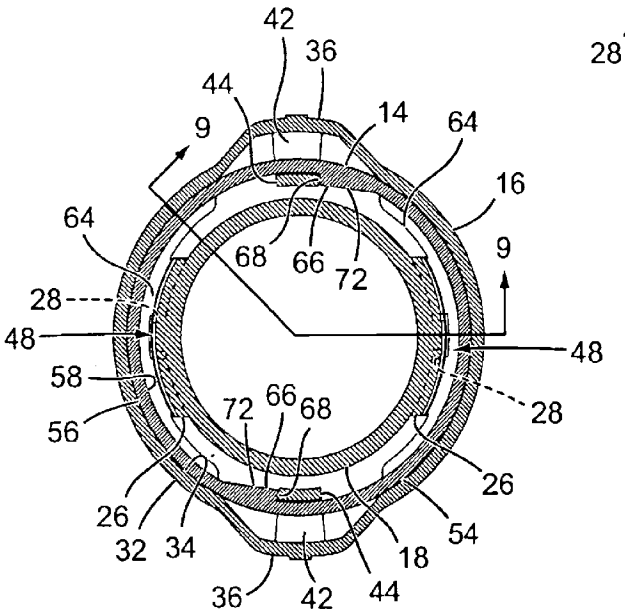
FIG. 8 is a cross-section plan view of the lock ring mounted on the container neck and the cap mounted on the container neck.

In all of the alternate embodiments of the cap 14, the cap has a cylindrical skirt 54 with opposite exterior 56 and interior 58 surfaces. A bottom annular surface 62 extends radially between the skirt exterior surface 56 and the skirt interior surface 58. The cap skirt 54 has a diameter dimension that enables the cap to fit over the container neck 18 and inside of the lock ring 16. The cap exterior surface 56 has a diameter dimension designed to enable the cap exterior surface to engage in sliding contact with the interior surface 34 of the lock ring 16 as shown in FIG. 8. The interior surface 58 of the cap skirt is formed with internal screw threading 64 that is complementary to the external screw threading 24 of the container neck 18. The cap could also be formed with other types of attachment mechanisms that are complementary to the attachment mechanism employed on the container neck, for example a bayonet fitting.

Figure 6:
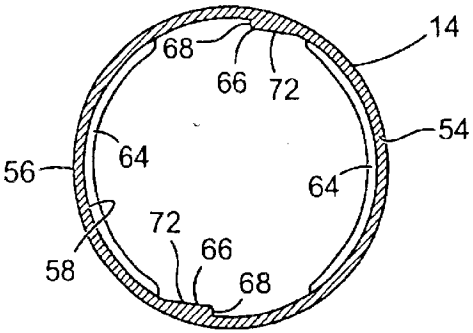
FIG. 6 is a cross-section plan view of the cap removed from the container.
Figure 12:
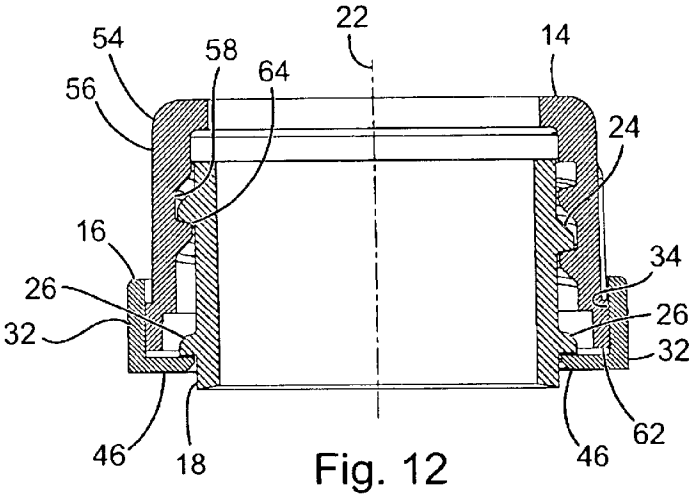
FIG. 12 is a cross-section view through the container neck, the lock ring and the cap in a plane positioned along the line 12—12 of FIG. 9.
Figure 10:
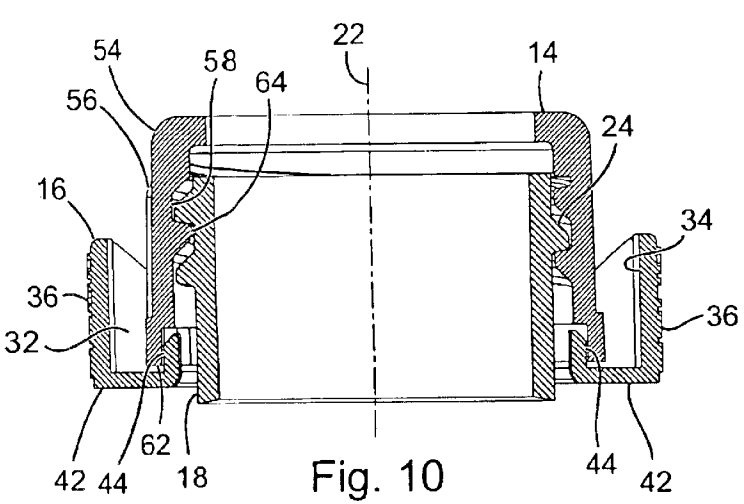
FIG. 10 is a cross-section view through the container neck, the lock ring and the cap in a plane positioned along the line 10—10 shown in FIG. 9.
Figure 11:
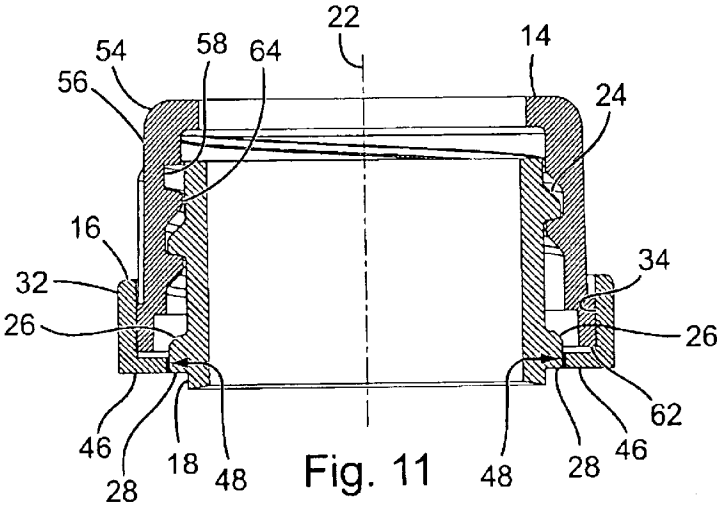
FIG. 11 is a cross-section view through the container neck, the lock ring and the cap in a plane positioned along the line 11—11 of FIG. 9.

The cap interior surface 58 is also provided with a pair of lugs 66 that project outwardly from the interior surface on opposite sides of the cap as shown in FIG. 6. Each lug 66 is formed with a stop surface 68 and a cam surface 72. The stop surface 68 is positioned in a plane that intersects the center axis of the cap and the center axis 22 of the container neck 18 when the cap is attached to the container. The cam surface 72 extends perpendicularly from the stop surface 68 and merges with the cap interior surface 58.

In attaching the cap 14 to the container neck 18 with the lock ring 16 having been previously attached to the container neck 18 as described above, the cap 14 is positioned on the container neck 18 and rotated in a clockwise direction as is conventional with screw threaded attachment mechanisms or bayonet type attachment mechanisms. The rotation of the cap 14 causes the cap to move downwardly on the container neck 18. As the cap moves downwardly, the cap lugs 66 approach the hooks 44 of the lock ring clasps 42. The lug cam surfaces 72 come into engagement with the clasp hooks 44 and cause the clasp hooks to pass over the cam surfaces 72 of the lugs 66. The resiliency of the lock ring 16 enables the clasp hooks 44 to move radially inwardly as they slide over the lug cam surfaces 72. When the clasp hooks 44 of the lock ring 16 have passed over the cap lug cam surfaces 72, the resiliency of the lock ring causes the clasp hooks to snap into place against the cap lug stop surfaces 68 as shown in FIG. 8. The positioning of the clasp hooks 44 of the lock ring 16 adjacent the cap lug stop surfaces 68 prevents the cap 14 from being rotated in the counterclockwise direction on the container neck 18 to remove the cap from the container neck.

To remove the cap 14 from the container neck 18, it is necessary to first manually squeeze the finger pads 36 on the opposite sides of the lock ring 16, compressing the resiliency of the lock ring. This causes the clasp hooks 44 of the lock ring to move radially inwardly toward each other displacing the hooks 44 from their previous positions adjacent the cap lug stop surfaces 68. With the clasp hooks 44 displaced from the cap lug lock surfaces 68 by one hand of the user, the cap 14 can now be rotated in the counterclockwise direction by the other hand of the user to remove the cap from the container neck 18.

The lock ring of the child resistant closure apparatus of the invention is dimensioned to be employed with two different size container and cap assemblies. In the preferred embodiment, the lock ring may be employed with a container and cap assembly having a 24 mm diameter container neck and a 28 mm diameter container neck. However, container and cap assemblies having other container neck dimensions and cap dimensions may be employed by changing the dimensions of the lock ring. By enabling use of the single size lock ring with two different size container and cap assemblies to provide those assemblies with a child resistant closure apparatus, the manufacturing costs of the two different size container and cap assemblies is reduced.

In addition, because the lock ring is removably attached to the container by the resiliency of the lock ring and the engagement of the lock ring flanges 46 beneath the container neck ridges 26, the lock ring may be removed from the container if desired. This enables the child resistant closure apparatus of the invention to be removed from the container and cap assembly where it is desired that the container and cap assembly not have a child resistant closure apparatus.

While the present invention has been described above by reference to a specific embodiment, it should be understood that modifications and variations of the invention may be constructed without departing from the scope of the invention defined by the following claims.

What is claimed is:

1. A child resistant closure apparatus comprising:

a container having an interior volume, an opening in the container providing access to the container interior volume through the opening, and a cylindrical neck on the container extending around the container opening, the neck having a center axis that defines mutually perpendicular axial and radial directions relative to the container;

a cap mounted on the container neck for rotation of the cap about the container neck axis, the cap having a lug that projects outwardly from a surface of the cap; and a clasp on the container adjacent the container neck and the cap, the clasp being resiliently movable along the radial direction between a first position of the clasp relative to the container and a second position of the clasp relative to the container where the clasp engages with the cap lug in the first position of the clasp preventing the cap from rotating on the container neck and the clasp is displaced from the cap lug in the second position of the clasp where the clasp does not prevent rotation of the cap on the container neck.

2. The apparatus of claim 1, further comprising:

the clasp in the second position is radially closer to the container neck than the clasp in the first position.

3. The apparatus of claim 2, further comprising:

resiliency of the clasp urging the clasp from the second position to the first position.

4. The apparatus of claim 3, further comprising:

the clasp is one of a pair of clasps positioned on opposite sides of the container neck.

5. The apparatus of claim 1, further comprising:

a finger pad projects outwardly from the clasp to a position where the finger pad is easily accessible by a user's hand to move the clasp between the first and second position in response to manipulation of the finger pad.

6. The apparatus of claim 5, further comprising:

a trigger sprayer connected to the cap whereby the cap attaches the trigger sprayer to the container neck.

7. The apparatus of claim 5, further comprising:

the cap having a cylindrical skirt with opposite exterior and interior surfaces, the skirt interior surface opposes the container neck; and, the clasp finger pad overlaps the cap skirt exterior surface.

8. The apparatus of claim 7, further comprising:

the cap skirt having an annular bottom surface that extends radially between the cap skirt exterior and interior surfaces; and, the clasp extending beneath the cap skirt bottom surface between the cap skirt exterior and interior surface.

9. The apparatus of claim 8, further comprising:

the cap lug projecting outwardly from the cap skirt interior surface.

10. The apparatus of claim 7, further comprising:

a ring removably mounted on the container around the container neck; and the clasp being on the ring.

11. The apparatus of claim 10, further comprising:

the clasp projecting radially inwardly from the ring toward the container neck.

12. The apparatus of claim 10, further comprising:

the container neck having a ridge that projects radially outwardly from the container neck; and the ring having a flange that projects radially inwardly from the ring and engages with the container neck ridge thereby mounting the ring on the container and preventing axial movement of the ring on the container neck.

13. The apparatus of claim 12, further comprising:

the container neck having a rib that projects radially outwardly from the container neck; and, the ring flange having a notch that receives the container neck rib thereby preventing the ring from rotating on the container neck.

14. The apparatus of claim 5, further comprising:

the finger pad being moveable radially inwardly toward that container neck to move the clasp from the first position to the second position.

15. The apparatus of claim 14, further comprising:

the cap having a cylindrical skirt with opposite exterior and interior surfaces and an annular bottom surface that extends between the cap skirt exterior and interior surfaces; and, the clasp extends radially beneath the cap skirt bottom surface.

16. The apparatus of claim 15, further comprising:

a ring removably mounted on the container around the container neck; and, the clasp projecting from the ring and the finger pad being on the ring.

17. The apparatus of claim 16, further comprising:

the container neck having a ridge that projects radially outwardly from the container neck; and the ring having a flange that projects radially inwardly from the ring and engages with the container neck ridge thereby mounting the ring on the container and preventing axial movement of the ring relative to the container neck.

18. The apparatus of claim 17, further comprising:

the ring flange having a notch in the flange; and, a rib projecting radially outwardly from the container neck, the rib engaging in the ring flange notch thereby preventing rotation of the ring on the container neck.

19. The apparatus of claim 18, further comprising:

the clasp and the cap being removably attached to the container.

20. The apparatus of claim 19, further comprising:

a trigger sprayer, the cap being mounted on the trigger sprayer and removably attaching the trigger sprayer to the container.

21. The apparatus of claim 19, further comprising:

a ring removably attached to the container around the container neck, the clasp being on the ring.

22. The apparatus of claim 21, further comprising:

the cap having a cylindrical skirt with opposite exterior and interior surfaces and an annular bottom surface that extends between the cap skirt exterior and interior surface; and the clasp projects radially inwardly from the ring beneath the cap skirt bottom surface.

23. The apparatus of claim 22, further comprising:

the cap lug projects outwardly from the cap skirt interior surface.

24. The apparatus of claim 21, further comprising:

a ridge projecting radially outwardly from the container neck; and, a flange projecting radially inwardly from the ring and engaging with the container neck ridge thereby removably attaching the ring to the container and preventing axial movement of the ring relative to the container neck.

25. The apparatus of claim 24, further comprising:

a notch in the ring flange; and, a rib projecting outwardly from the container neck and engaging in the ring flange notch thereby preventing rotation of the ring on the container neck.

* * * * *